United States Patent [19]

Ginatta

[11] 4,097,354

[45] Jun. 27, 1978

[54] CONTINUOUS PROCESS FOR ELECTROLYTIC REFINING AND ELECTROWINNING OF ELEMENTS AND COMPOUNDS

[76] Inventor: Marco V. Ginatta, Corso Alberto Pico, 35, Turin, Italy

[21] Appl. No.: 685,305

[22] Filed: May 11, 1976

[30] Foreign Application Priority Data

May 12, 1975 Italy ..... 68194 A/75
Apr. 26, 1976 Italy ..... 68012 A/76

[51] Int. Cl.[2] ..... C25C 1/12; C25C 1/18; C25C 7/02

[52] U.S. Cl. ..... 204/206; 204/12; 204/13; 204/52 R; 204/53; 204/275

[58] Field of Search ..... 204/12, 13, 52 R, 105 R, 204/282, 206, 300, 775, 213, 208, 53

[56] References Cited

U.S. PATENT DOCUMENTS

| | | | |
|---|---|---|---|
| 2,433,441 | 12/1947 | Davidoff | 204/13 |
| 3,396,097 | 8/1968 | Wolcott | 204/300 |
| 3,920,530 | 11/1975 | Xylander | 204/152 |
| 4,001,100 | 1/1977 | Haydock | 204/202 X |

*Primary Examiner*—Arthur C. Prescott
*Attorney, Agent, or Firm*—Edwin E. Greigg

[57] ABSTRACT

A process and apparatus for the continuous electrolytic refining and electrochemical extraction of elements and compounds, in which cathodes and anodes, connected to a D.C. power supply, are continuously moved through a tank containing electrolyte along parallel paths with the direction of movement of the cathodes being opposite that of the anodes. Since the effective area of the cathodes increases as the effective area of the anodes decreases, the opposite motion of the anodes and cathodes tends to equalize the effective areas of the cathodes and anodes in close proximity with one another along the entire length of travel through the tank, thus allowing a higher current density to be maintained, and a high quality deposit on the cathodes. The cathodes and/or anodes can be in the form of a continuous sheet or a series of individual plates. Also, when continuous cathodes are used, the concentration of additives can be reduced, and thus the efficiency increased, by guiding the lower edge of the cathode in a groove which shields this edge, while allowing the upper edge of the continuous cathode to protrude above the surface of the electrolyte, thus preventing irregular edge deposits and allowing deposits only on the flat continuous surface of the cathodes.

16 Claims, 9 Drawing Figures

FIG. 3
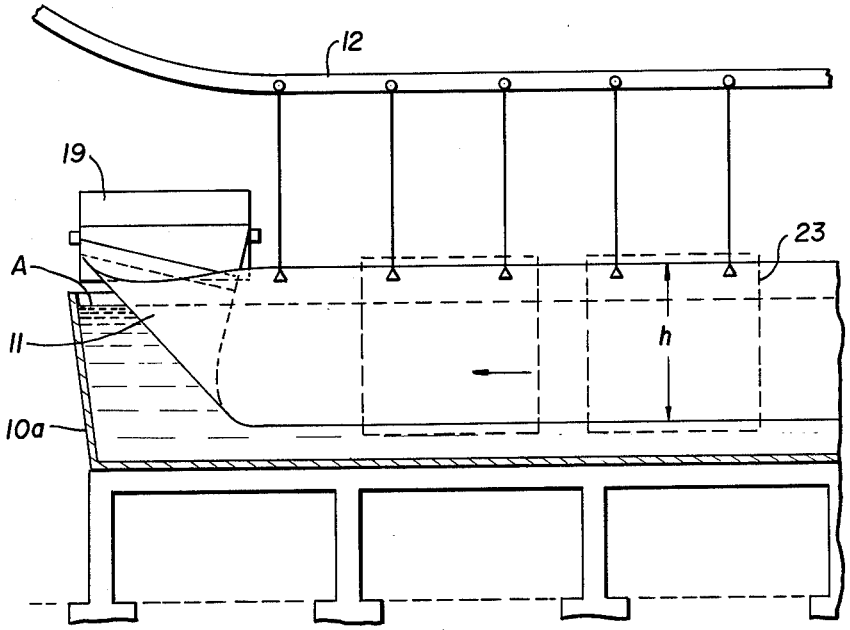
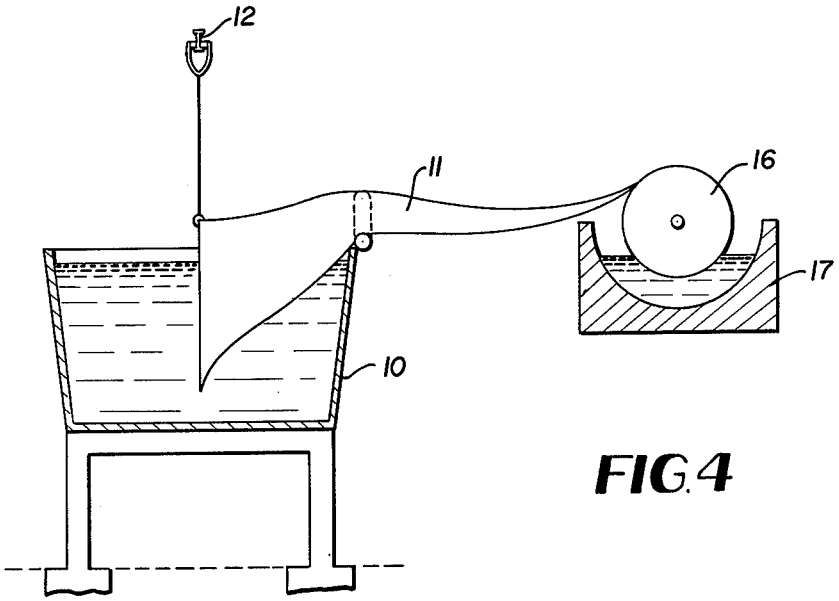
FIG. 4

FIG. 5
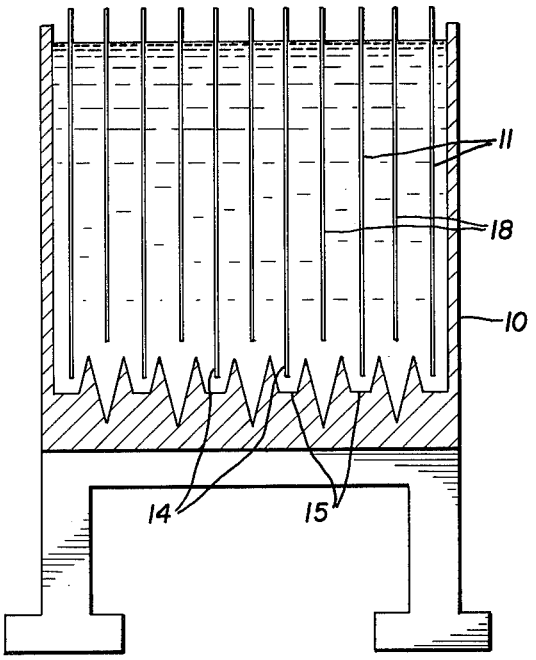
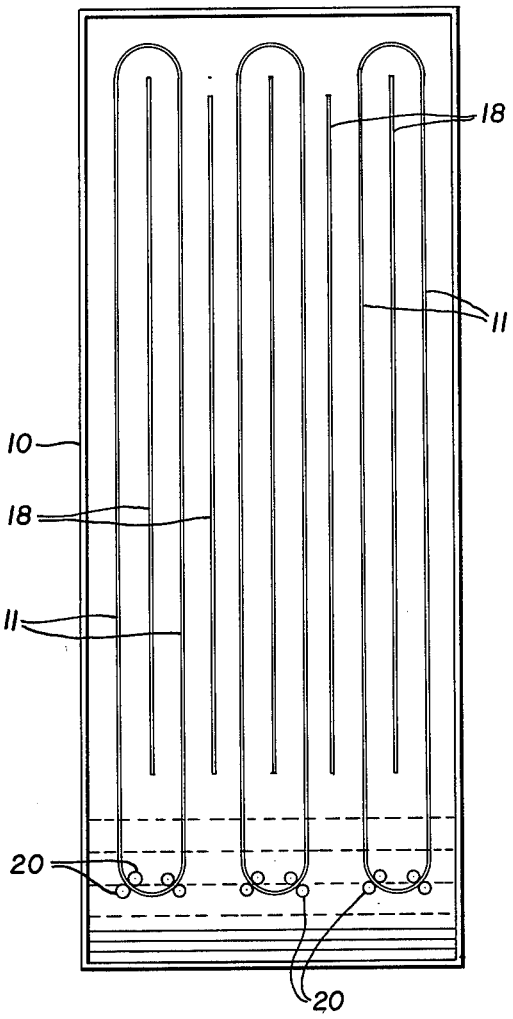
FIG. 6

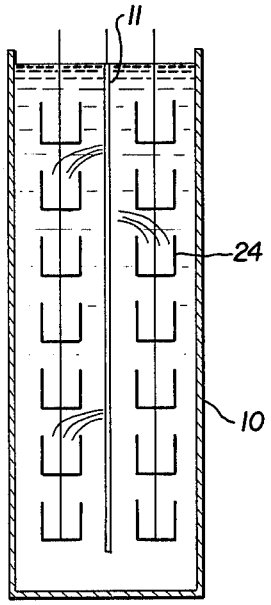
FIG. 7
FIG. 8
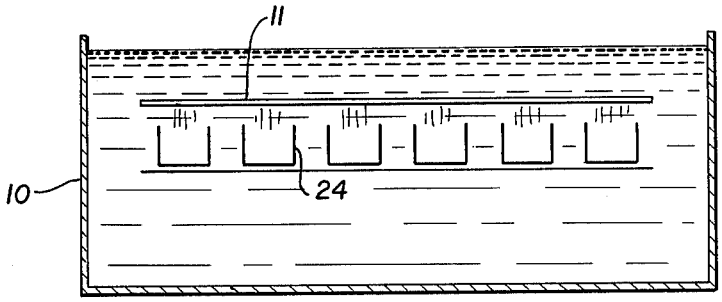
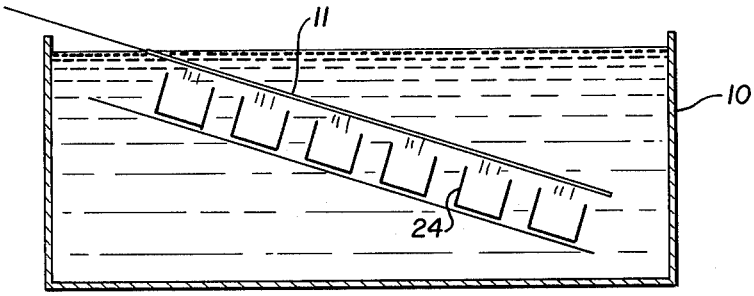
FIG. 9

CONTINUOUS PROCESS FOR ELECTROLYTIC REFINING AND ELECTROWINNING OF ELEMENTS AND COMPOUNDS

BACKGROUND OF THE INVENTION

Up to the present time, the known processes of electrolytic refining and electrochemical extraction of elements and compounds have been batch-type processes, that is, processes which are operated in a non-continuous manner.

For example, in the case of electrolytic refining of metals, the process begins with the immersion of a series of anodes of impure metal alternated with cathode starting sheets in tanks containing electrolyte solutions. Once the electric connections are established, the metal at the anodes dissolves and deposits on the cathodes. The process usually terminates when less than 15% of the original metal, together with all the impurities, are left at the anodes. The cathodes produced are then removed from the tanks, as well as what is left of the anodes.

The low efficiency of such a process has four principal causes:

1. The procedure of immersion in, and extraction from the tanks of anodes and cathodes requires extensive manual work.

2. During the whole duration of the process, except from a brief median period, the actual surfaces (which are different from the geometrical plane surface due to roughness, dendrites, etc.) of anodes and cathodes are never equivalent; it then follows that the optimal current density is strongly limited as follows:

in the first part of the process it is limited by the great diversity between the small actual surface of the cathodes, new and smooth, and the great actual surface of the anodes, which are not only larger in size than the cathodes but also have very irregular surfaces, since these anodes are generally produced by casting;

in the second part of the process, it is limited by the same type of unbalance in the other direction; the cathodes, rich with metal deposit, are large and with very irregular surfaces, while the anodes, much reduced in actual size, have their surfaces covered by the impurities left behind, reducing their effective area and hindering the dissolution process.

3. The low current density at the cathodes toward the end of the process does not protect the deposit from the attack of the electrolyte and from the adhesion of sludge, and, as a result, deterioration of the cathode surface occurs.

4. The maximum obtainable deposit thickness on the cathodes is limited by the formation of irregular-shaped deposits, generally on the cathode perimeter (high current density regions), that grow toward the anode until short circuiting the cell, thereby wasting electric energy; in order to minimize this phenomenon various additives are employed, in turn increasing costs and requiring the use of higher voltage.

OBJECTS AND SUMMARY OF THE INVENTION

Thus, it is an object of this invention to provide a process and apparatus for the electrolytic refining and the electrochemical extraction of metals, metalloids, elements and compounds, characterized by the fact that it is run in a continuous mode.

A further object of this invention is to provide a process and apparatus for increasing the current density over that obtained by known, batch-type processes, for the same quantity of electrodes, resulting in a significant time saving and thus a higher output for a given volume of electrolyte.

Another object of this invention is to provide a process and apparatus for preventing irregular or dendritic growth of the electrode deposit, thus permitting a lower concentration of additives for preventing such irregular growths, and increasing the efficiency.

In one embodiment of the present invention the single independent cathodes of the traditional batch-type methods are replaced by a continuous cathode consisting of one thin sheet of the same metal object of the process, or of any other electrically conductive material.

This metal sheet continuously enters at one end of the tank containing the electrolyte, receives the metal deposition as it moves the length of the tank, and exists from the other end of the tank where the cathode sheet, now thick, is collected. The cathode sheet is supported and advanced through the tank by appropriate holding devices which may also constitute the electrical connections for the anode. Either a series of the traditional individual anodes, or a continuous sheet anode, can be similarily moved through the tank along a path of travel parallel to the cathode, but in the opposite direction.

In this manner the anodes with large actual surfaces enter the tank at its opposite end and meet the outgoing cathodes loaded with metal deposit, also with large actual surfaces, which exit from that same end. In this region the highest possible current density is obtained. Likewise, at the opposite end of the tank, the exhausted and impurity covered anodes, about to exit, meet the new smooth cathodes entering the tank; here too the current density is the highest possible for either anodes or cathodes at this point, since both have quite small actual or effective surfaces.

Instead of the handling equipment generally used in traditional plants, such as overhead cranes, etc., transfer systems such as assembly chains, on which continuous cathodes or groups of continuous cathodes and anodes or groups of traditional or continuous anodes are attached, are used.

The complete plant can be made of a series of parallel continuous cathodes, alternated with lines of anodes, either traditional or continuous, travelling parallel to the cathodes but in an opposite direction.

The advantages of the method and apparatus of this invention over the traditional methods and apparatus can be summarized as follows:

1. The current density can be maintained at the electrochemical limiting value during the entire process.

2. The deposit can be obtained of a much thicker gauge since, as described herein, with the continuous cathodes there are no lateral edges. While the upper edge is above the electrolyte level, the lower edge is running in a groove that not only guides the cathode but also shields the high current density areas so to prevent irregular electrolytic deposits in the lower edge regions. Thus, there are no areas subject to irregular or dendritic growth of the deposit.

3. The concentration of additives for improving the morphological characteristics of the deposit can be maintained at much lower levels since flat surfaces present no particular problems such as the edges do.

4. The production of the starting sheets is simplified since no cutting, straightening or assembling the individual pieces is required when a continuous starting sheet is used.

5. Also the deterioration of the deposit during the final period of low current density is avoided.

These and other objects and advantages of the invention will become more apparent from the detailed description of the preferred embodiments found herein below.

BRIEF DESCRIPTION OF THE DRAWINGS

FIG. 3 is a partial cross-sectional side view of the embodiments of FIG. 1.

FIG. 4 is a partial cross-sectional end view of an embodiment of FIG. 1.

FIG. 5 is a cross-sectional end view of a further embodiment of this invention, which illustrates a special tank bottom design.

FIG. 6 is a top view of another embodiment of this invention in which a continuous cathode of the closed ring type is depicted.

FIG. 7 is a cross-sectional end view of an embodiment of this invention in which the anodes comprise the plates of spent storage batteries.

FIG. 8 is a cross-sectional end view of another embodiment of this invention in which the anodes comprise the plates of spent storage batteries.

FIG. 9 is a cross-sectional end view of yet another embodiment of this invention in which the anodes comprise the plates of spent storage batteries.

DESCRIPTION OF THE PREFERRED EMBODIMENTS

Figure 1:
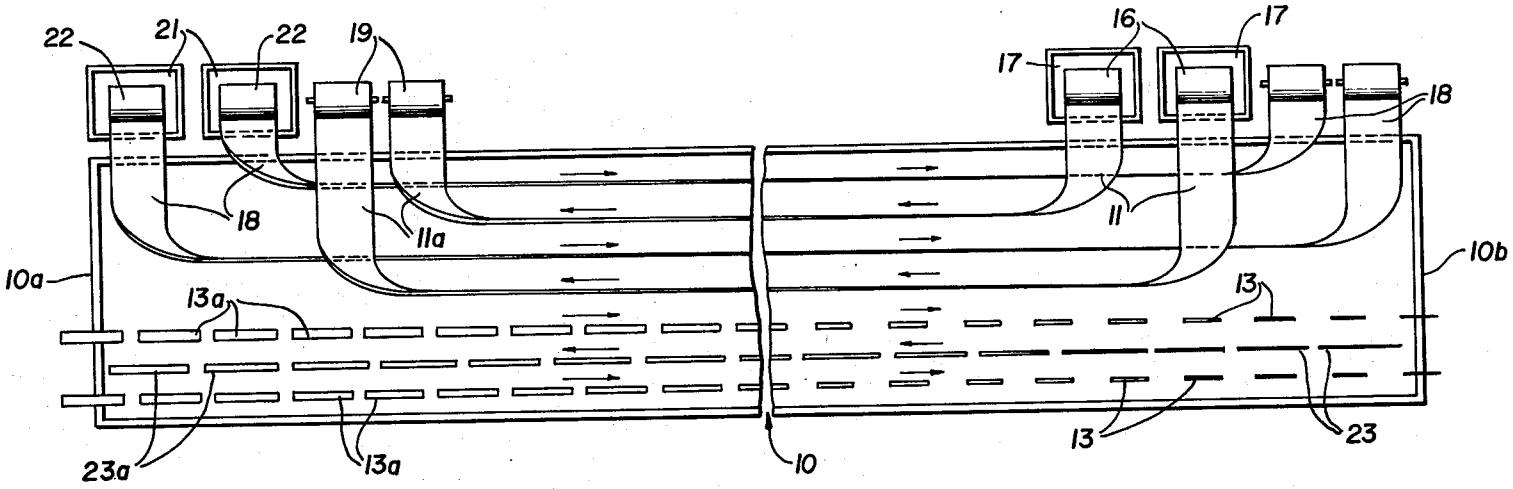
FIG. 1 is a top view of preferred embodiments of the invention.

Referring now to the drawings, FIGS. 1, 3 and 4 show a tank 10 containing electrolyte and having one end 10*a* and an opposite end 10*b*. One or more continuous cathodes 11 are supported and advanced at the desired speed along parallel paths by a transfer system best shown in FIGS. 3 and 4.

Each continuous cathode 11 has the form of a thin sheet or ribbon of the desired gauge and is continuously immersed at one end 10*b* of the tank 10, and continuously collected at the other end 10*a* of the tank 10 on a cylinder 19.

Also, in this disclosure, the lines of individual cathodes 23, 23*a* which are attached to and moved by the transfer means 12 as shown in dashed lines in FIG. 3, are considered to be continuous cathodes. Similarly, the continuous cathodes can have the form of a continuous flat belt 11', as shown in FIG. 6.

The height (*h*) of a continuous cathode can vary considerably, however, we have used continuous cathodes 2.4 meter high and found them very effective in improving productivity for a given tank surface.

As shown in FIG. 5, the lower side 14 of the continuous cathode 11 can advance inside a groove 15 at the bottom of the tank.

Any electrically conducting material can be used for the continuous cathode. Satisfactory results are obtained with a lead sheet 11 about one millimeter thick which can be easily produced on site by using a cooled cylinder 16 rotating and partially immersed in molten lead 17 as shown in FIGS. 1 and 4. This ribbon-like sheet 11 can be immediately immersed in the tank containing the electrolyte.

The anodes 18 shown in FIG. 1 are immersed at one end 10*a* of the tank 10 in lines alternating with the continuous cathodes 11; for the optimization of the process their relative speeds are carefully adjusted; the advancing can be continuous or intermittent. For example, for anodes lasting an average of 10 days, in a 40 meter-long tank, a speed of 15 cm/hr (relative advancement 30 cm/hr) would be appropriate to allow for the settling of the anodic mud. Referring again to FIG. 1 the ladles of molten lead 21 and the formation cylinders 22 are used for the production of anodes 11.

One main characteristic of this method is the counter movement of the anodes 18 with respect to the continuous cathodes 11, thus permitting the maximum current density. The tank 10 can be of any length while proportional to the advancing speed of the cathodes and/or anodes. Another characteristic of this method is the longitudinal alignment of the anode sections 13*a*, 13, facing the cathodes sections 23, 23*a*, which are also longitudinally aligned and countercurrently advanced, the anodes being countercurrently advanced with respect to the cathodes and/or vice versa. It is understood, in addition to the above, that the mode of operating by moving cathodes and keeping stationary anodes and vice versa, is comprised in the realization of this Following a portion of continuous cathode 11, it enters the tank 10 at the end 10*b*, and receives element deposits until it reaches the opposite end 10*a* where it exits. The procedure with which the continuous cathodes 11 are removed from the tank, is analogous to the entrance procedure, that is:

the horizontal cylinders 16 produce continuous cathodes in a horizontal position, or alternatively, they are uncoiled from coils previously produced; then each continuous cathode overpasses the edge of the tank still in an horizontal position, at this point, at one side of the sheet the supporting and advancing devices are secured to the transfer means 12. The unsupported side is allowed to progressively sink in the tank with the movement illustrated in FIG. 1, guided by guides and/or rolls, until it is in a vertical position, executing a partial Moebius torsion. The electrolyte level A is shown in FIG. 3.

For the exit from the tank, the lower side of the continuous cathode is guided by means of guides and/or rolls, and follows the same movements as described above in the opposite sequence, passing the edge of the tank in an horizontal position. Subsequently it is washed and rolled in coils or cut in sheets, etc. Alternatively, especially for cathodes of great thickness, the exit can take place through a vertical slit at the exit of the tank as illustrated in FIG. 1 for the cathode plate 23 wherein each slit is provided with sealing gaskets and/or sealing rolls as to minimize the escape of electrolyte. Such a device can also be used for the entrance into the tank of a very rigid starting sheet of continuous cathode. The sealing rolls can be brush-type or flat or with grooves and the rotation speed can be adjusted. The electrolyte that escapes through these slits will be collected in an ancillary tank and recirculated by mean of pumps etc., in the system, as a part of the regular circulation that will have to take place in any event. Said entrance and exit systems can also be employed for continuous anodes. As depicted in FIG. 6 and as mentioned above, the continuous cathode 11' can be in the shape of a ring or belt, that is, a ribbon-like sheet with the ends attached together. This type of continuous cathode will then run up and down all the length of the tank. This realization is particularly suited in the case of elements which have deposition on the cathodes of a fine dendritic morphology. The harvest of the deposit can be executed in any convenient point of the circuit; in FIG. 6 they are placed at one end 20. These harvesting devices for the detachment of the deposit can be such as fixed moving knives, fixed or moving brushes, etc.

When several continuous anodes 18 all moving in the same direction of travel are used in alternate arrangement with continuous cathode belts 11', only the portion of each continuous belt 11' traveling in the opposite direction from the direction traveled by the continuous anodes 18 could be utilized, with the remaining portion of the continuous belt 11' being shielded from, or raised above, the electrolyte to assure the highest possible current density as well as a high quality electrolytic deposit. However, even if both sides of the continuous belt 11' are immersed and equally spaced from the continuous anodes 18, the allowable current density and product quality will still exceed that of traditional methods using stationary cathodes and anodes, since the effective cathode working areas in close proximity with the continuous anodes 18 will be approximately constant at any point, rather than very large when the anode working area is small, and small when the anode working area is large.

Also, when both sides of the continuous cathode belts are immersed and utilized, the allowable current density could be increased by alternating the direction of travel of adjacent continuous anodes 18, and positioning each continuous anode 18 in close proximity with only one side of a continuous cathode belt 11', which is traveling in the opposite direction.

Figure 2:
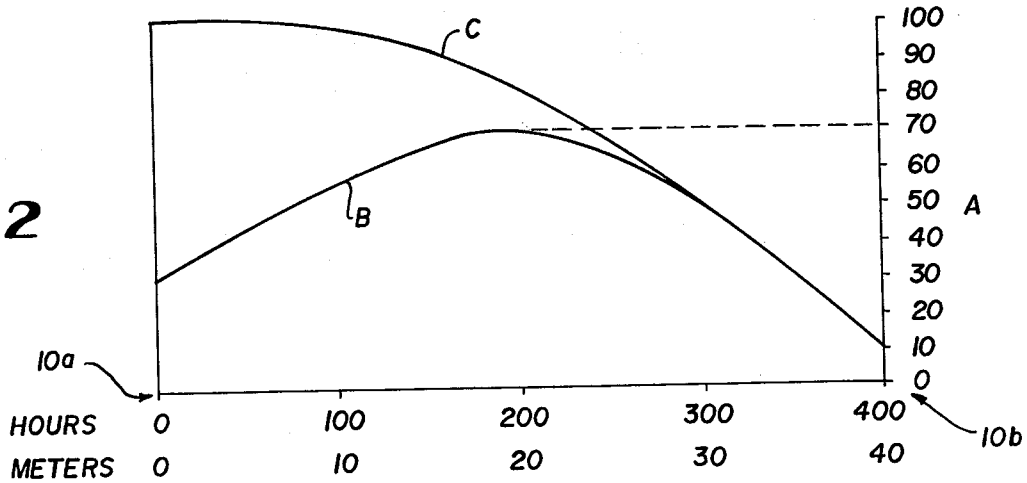
FIG. 2 is a diagram comparing current densities obtainable by traditional processes and the process herein disclosed.

The higher efficiency of the method object of this invention, as against traditional methods, is highlighted by the diagram in FIG. 2. To facilitate the comparison, a 40 meter long tank 10 and an electrolytic refining process with the same number of anodes and cathodes is used, lasting for 400 hours.

If the process is run in the traditional way, the variation with time of electric current input A is depicted by curve B; indeed, at the beginning of the process the current has a relatively low value (30 arbitrary current units), a value that is limited by the small actual surface of the new cathodes.

With the passing of time the current increases up to a maximum around the middle of the process (70 units at 200 hours); at this point cathodes and anodes have similar characteristics. After that the current diminishes to low final values (10 current units); this is due to the progressive dissolution of the anodes and consequential loss of actual surface.

If instead the process is run with the continuous method, as indicated in this invention, the variation with time of the electric current input is depicted by curve C; in fact at the end **10*a* of the tank 10, where the anodes 13*a*, 18 are new, facing them are the old cathodes 11*a*, 23*a*** loaded with deposit, and the current reaches very high values (100 Amperes) well above the maximum values obtained with traditional methods; this is so because the actual surfaces of anodes and cathodes are both the largest of any point in the process. In traditional processes, the highest current values are obtained at the middle of the process where anodes have already lost part of their metal, and cathodes are still incomplete.

One of the main characteristics of this invention is that for the whole length of the tanks and at any moment, cathodes are faced with anodes of very similar characteristics, and vice versa. This is the main effect of the counter-current movement of anodes and cathodes; in fact, cathodes increase their volume, while anodes decrease their volume, and therefore, the actual surface. As mentioned before, picking at random any point in the process, it will be found that anodes and cathodes have very similar characteristics, therefore allowing for the highest possible current density for both the anode and the cathode at that particular point; it follows that the process is never limited for the shortcoming of only one of the components.

Even at tank end **10*b* where the new cathodes allow for only a modest current density, the process is still efficient, since the old and impurity covered anodes facing them would not allow any higher current density; in the traditional processes at the same final point of the process the mature cathodes could carry much higher current density but are limited by the old anodes. Going back to FIG. 2, comparing the first time period of traditional processes with the left side of this process' tank (toward 10*a***), the values of current input are much higher with the continuous process; the shaded area between curve C and curve B represents the additional quantity of input electricity, and therefore the higher efficiency for the same quantity of anodes and cathodes of the continuous process as against the traditional ones. It follows then, that given equal quantities of metal to be refined, using the process object of this invention would result in a significant time saving, therefore a higher output for a given volume of electrolyte.

A particularly useful application of this invention is for the process for the electrochemical extraction of lead from spent electric storage batteries, as it is described below.

The extreme diversity of current density values monitored on the batteries from the beginning to the end of the process, require that the counter electrodes, cathodes, have particular characteristics such as to adjust to said current variations.

The batteries in the first hours of immersion are very active, allowing the passage of more than 10 $A/dm^2$ of current through the batteries opening; it is necessary therefore that the cathodes be able to receive a current density of at least 3 $A/dm^2$. Mature cathodes, that is with a thick, rough surface with globular dendrite-electrolytic deposition, have an actual surface a great deal larger than their flat geometric shape. It therefore is convenient to couple mature cathodes with batteries freshly immersed so to be able to obtain the maximum current density.

At the end of the process, when the batteries electrodes are about dissolved, the current density from the batteries is very low. As it was mentioned above, the mature cathodes have a very large actual surface, and under low cathodic current density condition, they tend to be attacked by the electrolyte, resulting in a poor quality deposit.

The optimization of the process is achieved by combining the old batteries with the new cathode whose actual surface is practically equal to their geometric flat area, so that the residual current density is sufficient to avoid the etching phenomenon.

The prerequisites above mentioned indicate as an ideal plant design the countercurrent system object of this invention, thereby moving the batteries 24 in the opposite direction with respect to the movement of the cathodes 11–11*a*. This system permits a constant dynamic matching of mature cathodes with freshly immersed batteries allowing for the maximum current density values, and the matching of new cathodes with nearly dissolved batteries at the lower current density values and no damage to the quality of the deposit. In all the intermediate points the current density capacity of batteries and cathodes will always be matched.

Furthermore, in order to be efficiently processed, the batteries 24 have to be placed with the cases opening pointing upward so that anodic mud will remain within the battery case. When the batteries so positioned, if we position the external counterelectrode cathode 11 vertically, we obtain the apparatus depicted in FIG. 7. It is easily noticeable that such a geometry is not the most appropriate in order to have the largest possible total current passage. This is due to the fact that the current lines in the electrolyte between batteries 24 and cathodes 11 are not straight lines. In order to maintain the batteries with their opening oriented upward, we have to modify the cathodes position. Here then we have an advantageous application of the continuous cathodes invention.

The batteries 24 and the continuous cathode 11' can both be disposed horizontally, as shown in FIG. 8, to obtain optimum yield.

Also, since the batteries 24 can still be efficiently processed when they are tilted to about 30°, both the batteries 24 and the continuous cathode 11 can be disposed at approximately 30° relative to the horizontal plane, as illustrated in FIG. 9. Because of the tilt in the cathodes 11 position, air bubbles released by the batteries do not adhere to the cathodes surface, as they would if they were horizontal, but slide upward with the low density electrolyte adjacent to the cathodes.

It is understood that if vertical cathodes 11 are desired, the batteries could be tilted toward it about 30° so to improve the current line in the electrolyte and obtain the complete extraction of the lead from the batteries 24. Furthermore, this process is particularly suited for the electrochemical production of oxides and various compounds by using insoluble anodes of the continuous type or in sections.

What is claimed is:

1. An apparatus for the continuous electrolytic refining and extraction of metals, metalloids, elements, compounds and alloys, which comprises:

a tank;

an electrolyte, contained within said tank;

continuous cathode means;

continuous anode means;

first transfer means for supporting and moving said continuous cathode means along a predetermined path between one end of said tank and an opposite end of said tank, said continuous cathode means being at least partially submersed in said electrolyte between said ends of said tank; and second transfer means for supporting and moving said continuous anode means along a path within said tank which is parallel to said predetermined path of said continuous cathode means, wherein each submersed portion of said continuous anode means moves in a direction of travel opposite the direction of travel of an adjacent portion of said continuous cathode means, between said ends of said tank, said anode means being at least partially submersed in said electrolyte.

2. An apparatus for the continuous electrolytic refining and extraction of metals, metalloids, elements, compounds and alloys as described in claim 1, wherein said continuous cathode means comprises at least one electrically-conductive ribbon or sheet of limited thickness which enters said tank at one end of the tank and leaves said tank at an opposite end of the tank.

3. An apparatus for the continuous electrolytic refining and extraction of metals, metalloids, elements, compounds and alloys as described in claim 2, which further comprises:

said tank, which includes guide groove means for a lower edge of said continuous cathode sheet to shield said lower edge and thus prevent irregular electrolytic deposits thereon: and wherein said continuous cathode sheet has an upper edge disposed above the level of said electrolyte.

4. An apparatus for the continuous electrolytic refining and extraction of metals, metalloids, elements, compounds and alloys, as described in claim 1, wherein said continuous cathode means comprises at least one line or series of individual longitudinally aligned cathodes, each supported by said transfer means and sequentially entering and leaving said tank at opposite ends of said tank.

5. An apparatus for the continuous electrolytic refining and extraction of metals, metalloids, elements, compounds and alloys, as described in claim 1, wherein said continuous cathode means comprises at least one electrically-conductive ribbon-like belt or ring, extending between said opposite ends of said tank, so that as said transfer means moves said cathode means, said cathode belt rotates within the tank; and which further comprises means for continuously harvesting the electrolytic deposit on said cathode belt at a convenient point on the path of travel of said belt.

6. An apparatus for the continuous electrolytic refining and extraction of metals, metalloids, elements, compounds and alloys, as described in claim 1, wherein said continuous anode means comprises at least one electrically-conductive ribbon or sheet of limited thickness which enters said tank at one end of the tank and leaves said tank at an opposite end of the tank.

7. An apparatus for the continuous electrolytic refining and extraction of metals, metalloids, elements, compounds and alloys, as described in claim 1, wherein said continuous anode means comprises at least one line or series of individual longitudinally aligned anodes each supported by said transfer means and sequentially entering and leaving said tank at said opposite ends of said tank.

8. An apparatus for the continuous electrolytic refining and extraction of metals, metalloids, elements, compounds and alloys, as described in claim 1, wherein said first and second transfer means further comprise electrical connections for said cathode and anode means, which are required for electrolytic processes.

9. An apparatus for the continuous electrolytic refining and extraction of metals, metalloids, elements, compounds and alloys, as described in claim 1, wherein said continuous cathode and anode means comprise a plurality of parallel continuous cathodes in alternate arrangement with a plurality of parallel continuous anodes.

10. An apparatus for the continuous electrolytic refining and extraction of metals, metalloids, elements, compounds and alloys, as described in claim 9, wherein each of said plurality of continuous cathodes comprises a partially-submersed, electrically-conductive ribbon or sheet of limited thickness, and said tank comprises a bottom member which includes guide grooves for the lower edge of each continuous cathode sheet, and depressions for collecting anodic muds, said grooves and depressions being disposed in alternate arrangement.

11. An apparatus for the continuous electrolytic refining and extraction of metals, metalloids, elements, compounds and alloys, as described in claim 9, wherein each of said plurality of continuous cathodes comprises an electrically-conductive belt or ring, extending between said ends of said tank and rotatable by said first transfer means, and which further comprises means for harvesting the electrolytic deposit on each cathode belt at a convenient point on the path of each said belt.

12. An apparatus for the continuous electrolytic refining and extraction of metals, metalloids, elements, compounds and alloys, as described in claim 9, wherein each of said plurality of continuous cathodes comprises a line of single, independent, longitudinally aligned cathodes, sequentially entering and leaving said tank at said opposite ends of said tank.

13. An apparatus for the continuous electrolytic refining and extraction of metals, metalloids, elements, compounds and alloys, as described in claim 1, wherein said continuous cathode means comprises at least one continuous cathode, which is horizontally disposed within said tank.

14. An apparatus for the continuous electrolytic refining and extraction of metals, metalloids, elements, compounds and alloys, as described in claim 1, wherein said continuous cathode means comprises at least one continuous cathode, which is disposed within said tank in an inclined position.

15. An apparatus for the continuous electrolytic refining and extraction of metals, metalloids, elements, compounds and alloys, as described in claim 1, wherein said continuous cathode means comprises a plurality of spent electric storage batteries, from which metals are electrochemically extracted.

16. An apparatus for the continuous electrolytic refining and extraction of metals, metalloids, elements, compounds and alloys, as described in claim 1, wherein said continuous anode means includes at least one continuous anode which is insoluble in said electrolyte.

* * * * *